US010030657B2

(12) United States Patent
Tozawa et al.

(10) Patent No.: US 10,030,657 B2
(45) Date of Patent: Jul. 24, 2018

(54) ELECTRIC COMPRESSOR AND METHOD FOR MANUFACTURING SAME

(71) Applicant: KABUSHIKI KAISHA TOYOTA JIDOSHOKKI, Kariya-shi, Aichi-ken (JP)

(72) Inventors: Kosaku Tozawa, Aichi-ken (JP); Takayuki Ota, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 335 days.

(21) Appl. No.: 14/600,263

(22) Filed: Jan. 20, 2015

(65) Prior Publication Data

US 2015/0204328 A1 Jul. 23, 2015

(30) Foreign Application Priority Data

Jan. 20, 2014 (JP) ..... 2014-007434

(51) Int. Cl.
*F04B 17/03* (2006.01)
*F04C 15/00* (2006.01)
(Continued)

(52) U.S. Cl.
CPC ..... *F04C 15/008* (2013.01); *F04C 18/0207* (2013.01); *F04C 18/0215* (2013.01);
(Continued)

(58) Field of Classification Search
CPC .. F04C 15/008; F04C 18/0215; F04C 29/021; F04C 18/0207; F04C 23/008; F04C 2240/30; F04C 2230/601
(Continued)

(56) References Cited

U.S. PATENT DOCUMENTS 3,229,961 A * 1/1966 Bodine, Jr. ..... B06B 1/186 366/124
4,600,367 A * 7/1986 Terauchi ..... B60H 1/3229 417/360
(Continued)

FOREIGN PATENT DOCUMENTS

JP 05-077640 A 3/1993

*Primary Examiner* — Charles Freay
(74) *Attorney, Agent, or Firm* — Sughrue Mion, PLLC

(57) ABSTRACT

There is provided an electric compressor to be fixed an object including a compression mechanism, an electric motor, a housing, a supporting member, and a plurality of vibration damping members. One of the housing and the supporting member has a recess and the other of the housing and the supporting member has a projection that is disposed in the recess and engaged with the recess to form a plurality of accommodating spaces on opposite sides of the projection, respectively. A filling rate of each vibration damping member in the corresponding accommodating space is changeable. There is also provided a method for manufacturing the electric compressor, including preparing a plurality of vibration damping members, choosing one of the vibration damping members, and providing the supporting member to the outer peripheral surface of the housing while accommodating the chosen vibration damping members in the respective accommodating spaces.

4 Claims, 8 Drawing Sheets

(51) Int. Cl.
*F04C 18/02* (2006.01)
*F04C 29/02* (2006.01)
*F04C 23/00* (2006.01)

(52) U.S. Cl.
CPC ..... *F04C 29/021* (2013.01); *F04C 23/008* (2013.01); *F04C 2230/601* (2013.01); *F04C 2240/30* (2013.01)

(58) Field of Classification Search
USPC ..... 417/363
See application file for complete search history.

(56) References Cited

U.S. PATENT DOCUMENTS 5,221,192 A * 6/1993 Heflin ..... F16F 1/373 248/638
5,623,483 A * 4/1997 Agrawal ..... H04J 3/0632 370/253
6,361,293 B1 * 3/2002 Harper ..... F04C 23/008 417/312
6,499,970 B1 * 12/2002 Siegel ..... B60T 8/3685 417/360
6,854,721 B2 * 2/2005 Kato ..... F16F 7/108 188/380
6,912,865 B2 * 7/2005 Seo ..... F16F 1/3732 181/207
8,770,948 B2 * 7/2014 Suitou ..... F01C 21/007 417/360
8,845,304 B2 * 9/2014 Sugiyama ..... F04B 35/04 417/360
2005/0169775 A1 * 8/2005 Yun ..... F04B 39/0044 417/363
2011/0243767 A1 * 10/2011 Tozawa ..... B60H 1/00521 417/410.1
2012/0251350 A1 * 10/2012 Suitou ..... B60H 1/00521 417/363
2012/0251357 A1 * 10/2012 Yokoi ..... B60H 1/00514 417/410.1
2012/0251358 A1 * 10/2012 Ota ..... F01C 21/10 417/410.5
2013/0017100 A1 * 1/2013 Ota ..... F01C 21/10 417/321
2013/0251557 A1 * 9/2013 Ota ..... F04B 17/03 417/410.1
2016/0040674 A1 * 2/2016 Fukasaku ..... F01C 21/007 417/363

* cited by examiner

ELECTRIC COMPRESSOR AND METHOD FOR MANUFACTURING SAME

BACKGROUND OF THE INVENTION

The present invention relates to an electric compressor and a method for manufacturing the same.

There has been provided an air conditioner for a vehicle having an electric compressor that is fixed through a supporting member to a body of the vehicle in an engine compartment of the vehicle. Japanese Patent Application Publication No. H05-77640 discloses a structure in which a compressor is mounted to a vehicle through support legs and a mounting plate. The support legs are fixed by circumferential welding to the compressor at a position adjacent to the center of gravity of the compressor and have therein a hole for receiving therein a rubber mounting. The mounting plate is fixedly connected to the vehicle and has a hole through which the compressor is inserted. The support legs fixed to the compressor are fixedly connected to the mounting plate by bolts with washes. Thus, the compressor is mounted to the vehicle body through the support legs, the rubber mounting and the mounting plate. The above-described structure prevents the compressor from being vibrated largely by external vibration applied to the mounting plate of the vehicle body while the vehicle is traveling.

In the background art disclosed by the above-cited Publication, however, if the resonance frequency of the rubber mounting (vibration damping member) coincides with the vibration frequency of the compressor, the amplitude of vibration of the compressor is increased and the increased vibration is transmitted through the support legs to the mounting plate of the body of the vehicle, with the result that noise development in the passenger compartment of the vehicle is increased. As a measure to solve this problem, it may be contemplated to provide a vibration damping member having a resonance frequency that is different from vibration frequency of the compressor. However, the vibration of the compressor and the vehicle has vibration frequency components over a wide range of frequencies. Therefore, merely changing the resonance frequency of the vibration damping member is unable to prevent the compressor from being vibrated under the influence of resonance.

The present invention, which has been made in light of the above problems, is directed to providing an electric compressor that suppresses vibration of the electric compressor by providing vibration damping members whose resonance frequencies are changed when the electric compressor vibrates.

SUMMARY OF THE INVENTION

In accordance with an aspect of the present invention, there is provided an electric compressor including a compression mechanism compressing refrigerant, an electric motor driving the compression mechanism, a housing accommodating therein the compression mechanism and the electric motor, a supporting member provided to an outer peripheral surface of the housing and having a mounting member, and a plurality of vibration damping members accommodated in the respective accommodating spaces. One of the housing and the supporting member has a recess and the other of the housing and the supporting member has a projection that is disposed in the recess and engaged with the recess to form a plurality of accommodating spaces on opposite sides of the projection, respectively. A filling rate of each vibration damping member in the corresponding accommodating space is changeable. The supporting member is configured to support the housing through the vibration damping members.

There is also provided a method for manufacturing an electric compressor to be fixed to an object, wherein the electric compressor has a compression mechanism compressing refrigerant, an electric motor driving the compression mechanism, a housing accommodating therein the compression mechanism and the electric motor, a supporting member provided to an outer peripheral surface of the housing and having a mounting member, and a plurality of vibration damping members accommodated in the respective accommodating spaces. One of the housing and the supporting member has a recess and the other of the housing and the supporting member has a projection that is disposed in the recess and engaged with the recess to form a plurality of accommodating spaces on opposite sides of the projection, respectively. A filling rate of each vibration damping member in the corresponding accommodating space is changeable. The supporting member is configured to support the housing through the vibration damping members. The method includes preparing a plurality of vibration damping members, filling rates of the vibration damping members being different from each other, choosing one of the plural vibration damping members that can change a resonance frequency thereof according to amplitude of vibration of the compressor, and providing the supporting member to the outer peripheral surface of the housing while accommodating the chosen vibration damping members in the respective accommodating spaces.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

First Embodiment

Figure 1:
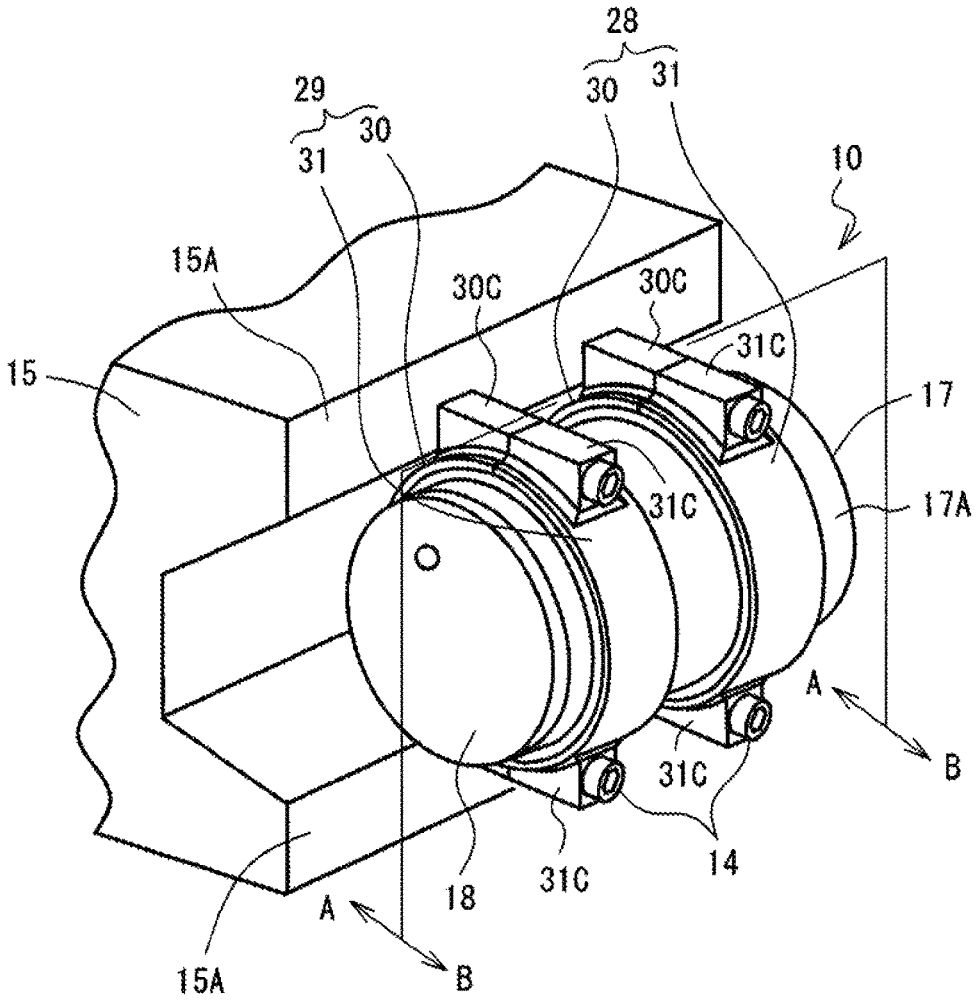
FIG. 1 is a perspective view of an electric compressor according to a first embodiment of the present invention.
Figure 2:
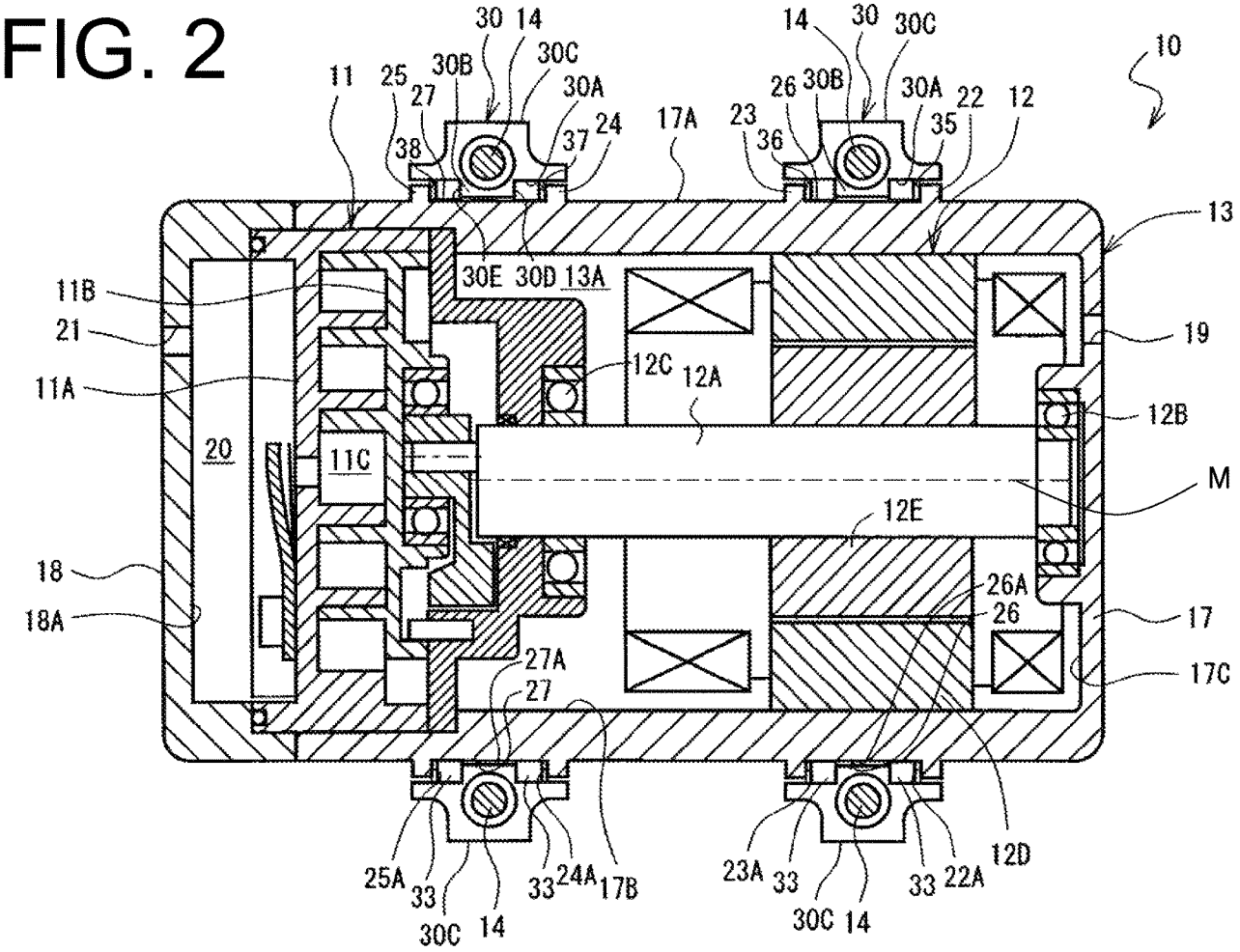
FIG. 2 is a longitudinal sectional view taken along the line A-A of FIG. 1.

The following will describe an electric compressor of a first embodiment according to the present invention with reference to FIGS. 1 through 8. Referring to FIGS. 1 and 2, the electric compressor that is designated by numeral 10 is disposed in an engine compartment of a vehicle and adapted for use in an air conditioner for controlling the temperature of passenger compartment. The electric compressor 10 includes a compression mechanism 11, an electric motor 12, a housing 13 having therein the compression mechanism 11 and the electric motor 12, and two supporting members 28, 29 each having a mounting member that mounts the electric compressor 10 to an object 15 by bolts 14 as the fastener. As shown in FIG. 1, the object 15 such as a frame or the engine of the vehicle has two projections 15A. Each projection 15A has therein two screw holes (not shown in the drawing) that open on the vertical surface of the projection 15A that faces the mounting member of the supporting members 28, 29.

As shown in FIG. 2, the housing 13 includes a first housing 17 that opens at one end thereof (left side end as seen of FIG. 2) and a second housing 18 that closes the one end of the first housing 17, thus forming a cylindrical shape. The housing 13 has therein an accommodating space 13A accommodating the compression mechanism 11 and the electric motor 12. The first housing 17 and the second housing 18 are made of a metal such as steel or aluminum.

The compression mechanism 11 includes a fixed scroll member 11A fixed to an inner peripheral surface 17B of the first housing 17 and a movable scroll member 11B disposed facing the fixed scroll member 11A. The engagement between the fixed scroll member 11A and the movable scroll member 11B forms a compression chamber 11C between the fixed scroll member 11A and the movable scroll member 11B. A drive shaft 12A extends in the first housing 17. The drive shaft 12A is supported at one end thereof by a bearing 12C and at the other end thereof by a bearing 12B.

The electric motor 12 is disposed in the accommodating space 13A on the side thereof that is adjacent to a bottom 17C of the first housing 17. A stator 12D is fixed to the inner peripheral surface 17B of the first housing 17. The stator 12D is supplied with three-phase AC power from a drive circuit (not shown in the drawing). A rotor 12E is fixed on the drive shaft 12A at a position that is radially inward of the stator 12D. The rotor 12E is rotated as the stator 12D is supplied with three-phase AC power. Thus, the electric motor 12 includes the drive shaft 12A, the stator 12D, and the rotor 12E.

An inlet port 19 is formed through the bottom 17C of the first housing 17. The inlet port 19 is connected to an external refrigerant circuit (not shown in the drawing). A discharge chamber 20 is formed between the second housing 18 and the fixed scroll member 11A. An outlet port 21 is formed through a bottom 18A of the second housing 18. The outlet port 21 is connected to the external refrigerant circuit through a tube (not shown in the drawing). When the compression mechanism 11 is operated by the rotation of the electric motor 12, the compression mechanism 11 draws in refrigerant from the external refrigerant circuit through the inlet port 19, compresses the refrigerant, and discharges the compressed refrigerant into the external refrigerant circuit through the outlet port 21.

Figure 3:
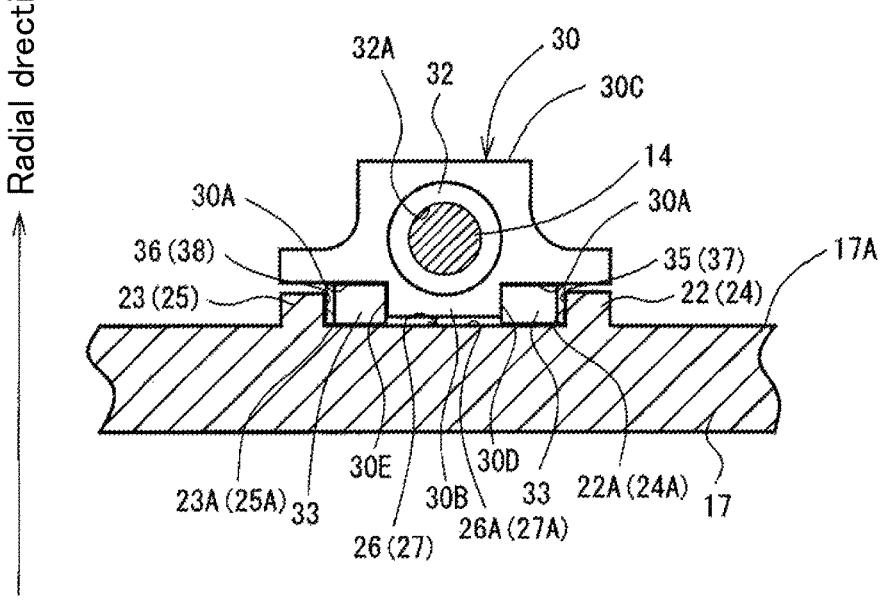
FIG. 3 is an enlarged sectional view taken along the line A-A of FIG. 1, showing a first support of the compressor of FIG. 1.

As shown in FIG. 2, the first housing 17 has four ribs 22, 23, 24, 25 that extends radially outward from the outer peripheral surface 17A of the first housing 17. The ribs 22-25 extend circumferentially around the first housing 17. A recess 26 is formed between the two ribs 22, 23 that are located at a position adjacent to the other end of the first housing 17. As shown in FIG. 3, the recess 26 is formed by an inner wall surface 22A of the rib 22, an inner wall surface 23A of the rib 23, and a bottom surface 26A, the bottom surface 26A is a part of the outer peripheral surface 17A of the first housing 17 that is located between the ribs 22, 23. A recess 27 is formed between the two ribs 24, 25 that are located at a position adjacent to the one end of the first housing 17. The recess 27 is formed by an inner wall surface 24A of the rib 24, an inner wall surface 25A of the rib 25, and a bottom surface 27A, the bottom surface 27A is a part of the outer peripheral surface 17A of the first housing 17 that is located between the ribs 24, 25. The recesses 26, 27 are located at positions on the outer peripheral surface 17A of the first housing 17 that are adjacent to the electric motor 12 and the compression mechanism 11, respectively.

As shown in FIG. 1, the supporting members 28, 29 are provided to surround the entire periphery of the first housing 17. The supporting members 28, 29 are disposed at positions corresponding to the recesses 26, 27, respectively. The supporting members 28, 29 have substantially the same configuration, each including a first support 30 and a second support 31. The first and second supports 30, 31 are of substantially the same semi-cylindrical shape, so that the supporting members 28, 29 having the first and second supports 30, 31 engaged with each other are formed in a cylindrical shape. A projection 30B is formed extending radially inward from the inner peripheral surface 30A of the first support 30 (refer to FIG. 3). Similarly, a projection 31B is formed extending from the inner peripheral surface 31A of the second support 31 (refer to FIG. 4). The projections 30B, 31B correspond to the projection of the present invention. The projection 30B of the first support 30 and the projection 31B of the second support 31 are disposed in the recesses 26, 27 of the first housing 17, respectively. The first and second supports 30, 31 are made of a vibration damping material such as resin or fiber reinforced resin.

Figure 4:
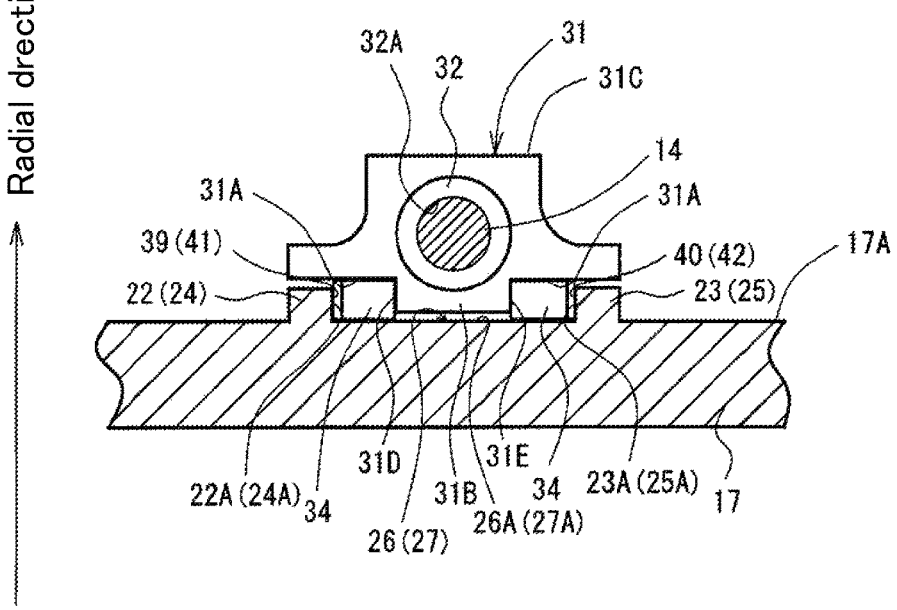
FIG. 4 is an enlarged sectional view taken along line B-B of FIG. 1, showing a second support of the compressor of FIG. 1.

Each first support 30 has two first mount members 30C at the both ends in the circumferential extending direction. Similarly, each second support 31 has two second mount members 31C at the both ends in the circumferential extending direction. As shown in FIGS. 3 and 4, the first mount member 30C has a reinforcement member 32 that is made of an insert-molded metal and has therein a hole 32A. Similarly, the second mount member 31C has the reinforcement member 32 that is made of an insert-molded metal and has therein the hole 32A. With the first support 30 and the second support 31 combined together around the first housing 17, the holes 32A of the first mount member 30C and the second mount member 31C are set in alignment with each other. The first and second supports 30, 31 are assembled to the object 15 with the bolts 14 inserted through the holes 32A and screwed into the holes (not shown) formed in the projection 15A of the object 15.

As shown in FIGS. 2 and 3, the projection 30B is disposed in the recess 26, with the result that two separate accommodating spaces 35, 36 are formed on the opposite sides of the projection 30B. The accommodating spaces 35, 36 are in communication by a space between the projections 30B and the bottom surface 26A of the recess 26. The accommodating space 35 is formed in a rectangular shape in cross section by a space that is surrounded by the inner peripheral surface 30A of the first support 30, a side surface 30D adjacent to the rib 22 of the projection 30B, the inner wall surface 22A of the rib 22 of the first housing 17, and the bottom surface 26A of the recess 26. Similarly, the accommodating space 36 is formed in a rectangular shape in cross section by a space that is surrounded by the inner peripheral surface 30A of the first support 30, a side surface 30E adjacent to the rib 23 of the projection 30B, the inner wall surface 23A of the rib 23 of the first housing 17, and the bottom surface 26A of the recess 26 and has a rectangular sectional shape.

As shown in FIG. 3, the projection 30B is disposed in the recess 27, with the result that two separate accommodating spaces 37, 38 are formed on the opposite sides of the projection 30B. The accommodating spaces 37, 38 are in communication by a space between the projection 30B and the bottom surface 27A of the recess 27. The accommodating space 37 is formed in a rectangular shape in cross section by a space that is surrounded by the inner peripheral surface 30A of the first support 30, the side surface 30D adjacent to the rib 24 of the projection 30B, the inner wall surface 24A of the rib 24 of the first housing 17, and the bottom surface 27A of the recess 27. The accommodating space 37 has substantially the same shape as the accommodating space 35. The accommodating space 38 is formed in a rectangular shape in cross section by a space that is surrounded by the inner peripheral surface 30A of the first support 30, a side surface 30E adjacent to the rib 25 of the projection 30B, the inner wall surface 25A of the rib 25 of the first housing 17, and the bottom surface 27A of the recess 27. The accommodating space 38 has substantially the same shape as the accommodating space 36.

As shown in FIG. 4, the projection 31B is disposed in the recess 26, with the result that two separate accommodating spaces 39, 40 are formed on the opposite sides of the projection 31B. The accommodating spaces 39, 40 are in communication by a space between the projections 31B and the bottom surface 26A of the recess 26. The accommodating space 39 is formed in a rectangular shape in cross section by a space that is surrounded by the inner peripheral surface 31A of the first support 31, a side surface 31D adjacent to the rib 22 of the projection 31B, the inner wall surface 22A of the rib 22 of the first housing 17, and the bottom surface 26A of the recess 26. Similarly, the accommodating space 40 is formed in a rectangular shape in cross section by a space surrounded by the inner peripheral surface 31A of the first support 31, a side surface 31E adjacent to the rib 23 of the projection 31B, the inner wall surface 23A of the rib 23 of the first housing 17, and the bottom surface 26A of the recess 26.

As shown in FIG. 4, the projection 31B is disposed in the recess 27, with the result that two separate accommodating spaces 41, 42 are formed on the opposite sides of the projection 31B. The accommodating spaces 41, 42 are in communication by a space between the projection 31B and the bottom surface 27A of the recess 27. The accommodating space 41 is formed in a rectangular shape in cross section by a space that is surrounded by the inner peripheral surface 31A of the first support 31, the side surface 31D adjacent to the rib 24 of the projection 31B, the inner wall surface 24A of the rib 24 of the first housing 17, and the bottom surface 27A of the recess 27. The accommodating space 41 has substantially the same shape as the accommodating space 39. The accommodating space 42 is formed in a rectangular shape in cross section by a space that is surrounded by the inner peripheral surface 31A of the first support 31, the side surface 31E adjacent to the rib 25 of the projection 31B, the inner wall surface 25A of the rib 25 of the first housing 17, and the bottom surface 27A of the recess 27. The accommodating space 42 has substantially the same shape as the accommodating space 40. With the first support 30 and the second support 31 assembled together around the first housing 17, the accommodating spaces 35, 36, 37, 38 are set in communication with the accommodating spaces 39, 40, 41, 42, respectively, so that accommodating spaces having a cylindrical annular shape are formed.

A first vibration damping member 33 is provided in each of the accommodating spaces 35-38. A second vibration damping member 34 is provided in each of the accommodating spaces 39-42. With the projections 30B, 31B and the recesses 26, 27 engaged through the first and second vibration damping members 33, 34, respectively, the first and second supports 30, 31 support the first housing 17. As shown in FIGS. 2 and 3, the first vibration damping member 33 is received in each of the accommodating spaces 35-38 in a curved shape. As shown in FIG. 4, the second vibration damping member 34 is received in each of the accommodating spaces 39-42 in a curved shape.

As shown in FIGS. 3 and 4, the first and second vibration damping members 33, 34 are pressed in radial direction in the respective accommodating spaces 35-42 with a clearance formed between the first and second vibration damping members 33, 34 and their adjacent ribs 22-25. The first and second vibration damping members 33, 34 are made of rubber having elasticity. Specifically, the first and second vibration damping members 33, 34 should preferably be made of such material having at least one of heat resistance and durability as silicon rubber or ethylene-propylene rubber. The first and second vibration damping members 33, 34 have a rectangular sectional shape. The first and second vibration damping members 33, 34 are combined with each other, so that part of the outer peripheral surface 17A of the first housing 17 is surrounded by the first and second vibration damping members 33, 34 throughout its entire circumference.

As shown in FIG. 1, the two supporting members 28, 29 each including the first and second supports 30, 31 are mounted to the electric compressor 10 and the electric compressor 10 is fixed to the object 15 at four positions, or at two positions by each support. The first and second supports 30, 31 of each supporting member 28, 29 which are fixed to the object 15 by the bolts 14 support the first housing 17 through the first and second vibration damping members 33, 34. Thus, the first and second supports 30, 31 are not directly connected, but connected indirectly to the first housing 17 through the first and second vibration damping members 33, 34.

Figure 5A:
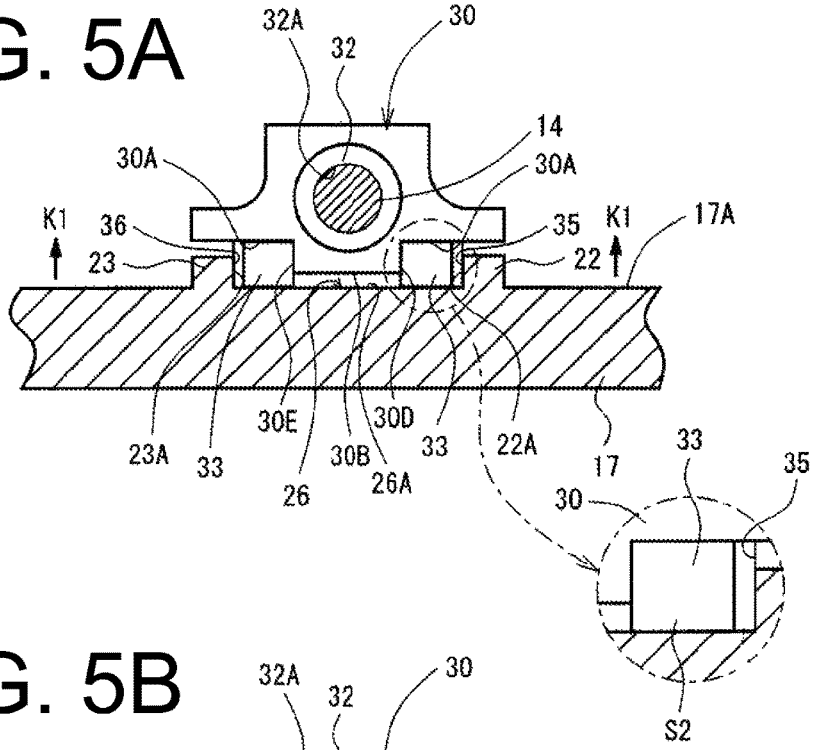
FIGS. 5A and 5B are schematic views showing the relation between the vibration of the electric compressor of FIG. 1 and the filling rate of a vibration damping member.
Figure 5B:
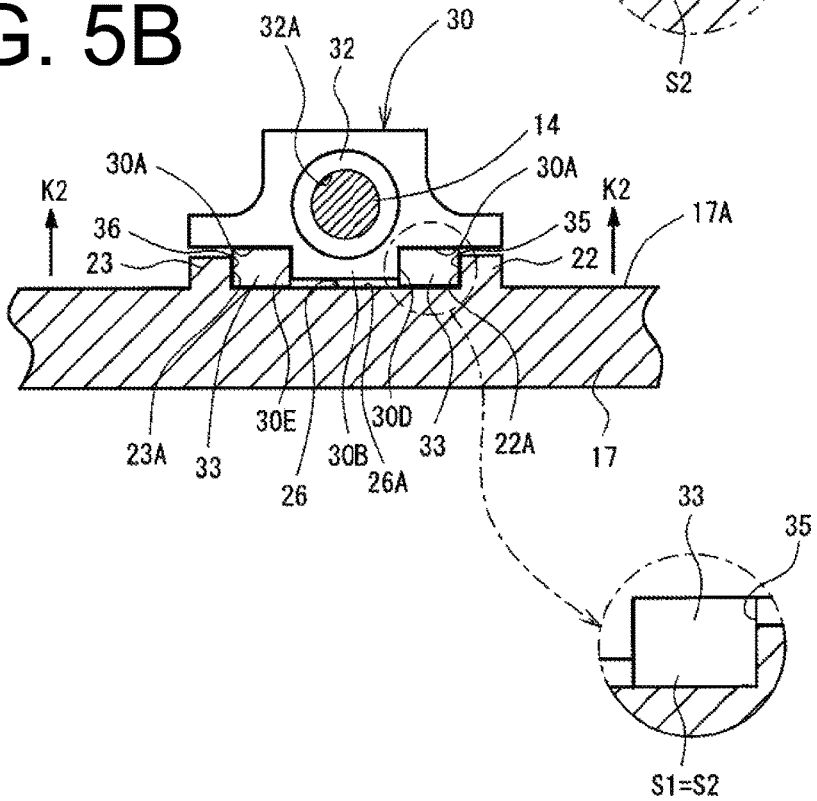

In the electric compressor 10 according to the first embodiment, the filling rate of the first and second vibration damping members 33, 34 in each of the accommodating spaces 35-42 can be changed according to the amplitude of vibration of the electric compressor 10. For example, in a case that the amplitude of vibration of the electric compressor 10 is small, the filling rate of the first and second vibration damping members 33, 34 in each of the accommodating spaces 35-42 may be set to be less than 100%. In this case, a clearance is formed in each of the accommodating spaces 35-42 between the first and second vibration damping members 33, 34 and their adjacent ribs 22-25, so that the first and second vibration damping members 33, 34 are deformable in the accommodating spaces 35-42. That is, the accommodating spaces 35-42 having therein the first and second vibration damping members 33, 34 is so configured that the filling rate of the first and second vibration damping members 33, 34 can be changed. The filling rate of the first and second vibration damping members 33, 34 less than 100% permits a clearance to be formed in each of the accommodating spaces 35-42. When the amplitude of vibration of the electric compressor 10 is large, the filling rate of the first and second vibration damping members 33, 34 in the accommodating spaces 35-42 may be increased to 100%. In this case, the accommodating spaces 35-42 are filled completely with the first and second vibration damping members 33, 34 with no clearance and the first and second vibration damping members 33, 34 can not be deformed in the accommodating space 35-42 and no deformation of the first and second vibration damping members 33, 34 occurs in the accommodating space 35-42. It is noted that the filling rate of a vibration damping member in an accommodating space is defined as the ratio of the volume of the vibration damping member in the accommodating space to the total volume of the accommodating space. Referring to FIGS. 5A and 5B, which are the sectional views passing through the axis M of the drive shaft 12A, 51 is the sectional area of each of the accommodating spaces 35, 36 and S2 is the sectional area of each of the first vibration damping member 33, respectively. The filling rate H is expressed by equation: H=S2/S1*100(%). The filling rate of less than 100% means that the sectional area S2 of the first vibration damping member 33 is smaller than the sectional area S1 of the accommodating spaces 35, 36 and, therefore, the first vibration damping member 33 is deformable (or a clearance is present) in the accommodating spaces 35, 36, as shown in FIG. 5A. The filling rate of 100% means that the sectional area S2 of the first vibration damping member 33 is substantially the same as the sectional area S1 of the accommodating spaces 35, 36 and, therefore, the first vibration damping member 33 can not be deformed (or no clearance is present) in the accommodating spaces 35, 36, as shown in FIG. 5B.

The filling rate H of the first and second vibration damping members 33, 34 of the accommodating spaces 35-42 may be changed according to the amplitude of vibration of the electric compressor 10. When the filling rate H of the first and second vibration damping members 33, 34 is 100%, the resonance frequency of the first and second vibration damping member 33, 34 is changed from the resonance frequency when the filling rate H is less than 100%. It is noted that a vibration damping member resonates at its resonance frequency and vibrates with the maximum amplitude. That is, when the vibration damping member is caused to vibrate by vibration frequency of an electric compressor and having a frequency that corresponds to the resonance frequency F0 of the vibration damping member, the vibration is amplified and vibration with a large amplitude occurs. This is a phenomenon called resonance and the frequency at resonance is called resonance frequency. In this case, the resonance frequency F0 of the vibration damping member corresponds to vibration frequency of the electric compressor.

The following will describe a method for manufacturing the electric compressor 10. In the first step, a plurality of vibration damping members having different filling rates H for the accommodating spaces 35-42 is prepared. In the second step, the vibration damping member that has the resonance frequency F0 is chosen for the first and second vibration damping members 33, 34. That is, the first and second vibration damping members 33, 34 are chosen so that their filling rate in the respective accommodating spaces 35-42 is 100% according to the amplitude of the vibration of the electric compressor 10. Then, it is noted that the resonance frequency of the first and second vibration damping members 33, 34 when their filling rate in the respective accommodating spaces 35-42 is 100%, is different from the resonance frequency F0. In the third step, the chosen vibration damping members are set in the accommodating spaces 35-42 and the supporting members 28, 29 are assembled to the housing 13.

Referring to FIGS. 5A and 5B, the following will describe the operation of the electric compressor 10 having the configuration described above. The operation of the first vibration damping member 33 accommodated in the accommodating spaces 35, 36 will be described below. When the amplitude of vibration of the electric compressor 10 is small, the load K1 applied to the first vibration damping member 33 through the first housing 17 is small, so that the deformation of the first vibration damping member 33 is small and the filling rate of the first vibration damping member 33 is less than 100%, as shown in FIG. 5A. (S1>S2) That is, the accommodating spaces 35, 36 have therein a clearance formed between the first vibration damping member 33 and the ribs 22, 23.

Because of the presence of the clearance in the accommodating spaces 35, 36, non-contact surface of the first vibration damping member 33 is secured between the first vibration damping member 33 and the ribs 22, 23 and rigidity of the first vibration damping member 33 is decreased.

On the other hand, as shown in FIG. 5B, when the amplitude of vibration of the electric compressor 10 is large, a large load K2 is applied to the first vibration damping member 33 through the first housing 17, so that deformation of the first vibration damping member 33 is large, as shown in FIG. 5B, and the filling rate of the first vibration damping member 33 becomes 100% (S1=S2). That is, the accommodating spaces 35, 36 have therein the first vibration damping member 33 with no clearance. The first vibration damping member 33 can not be deformed anymore. Therefore, the rigidity of the first vibration damping member 33 is increased because the first vibration damping member 33 does not have non-contact surface.

Figure 6:
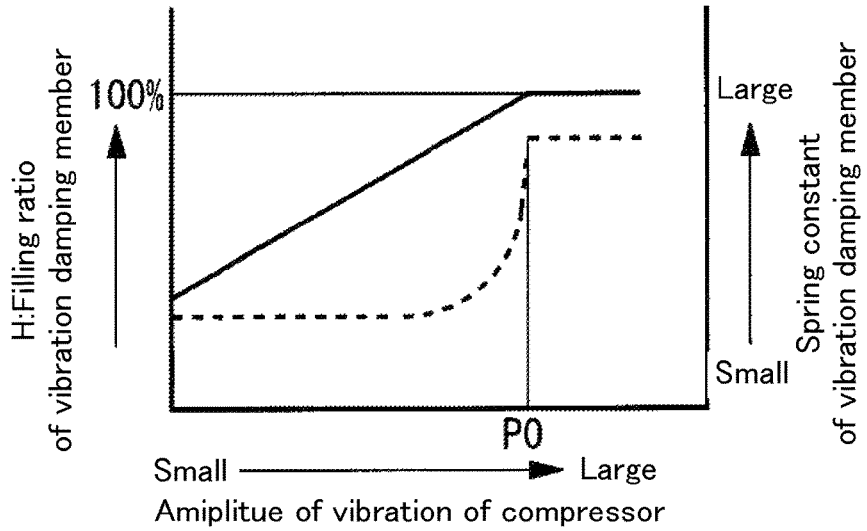
FIG. 6 is a graph showing the relations between the vibration of the electric compressor of FIG. 1 and the filling rate and the spring constant of the vibration damping member.

Referring to FIG. 6, the relation between the amplitude of vibration of the electric compressor and the filling rate H of the vibration damping member is indicated by the solid line. The relation between the amplitude of vibration of the electric compressor and the spring constant of the vibration damping member is indicated as the characteristics by the broken line. The filling rate H of the vibration damping member increases gradually with an increase of the amplitude of vibration of the electric compressor and becomes 100% at the amplitude P0. The spring constant of the vibration damping member remains constant in a region of the amplitude below before the level P0, but increases rapidly thereafter until the amplitude P0 is reached. In the vibration damping member, the spring constant is proportional to the rigidity. The resonance frequency F0 of the vibration damping member is proportional to the rigidity and spring constant of the vibration damping member. The resonance frequency F0 of the vibration damping member is inversely proportional to its mass.

Figure 7:
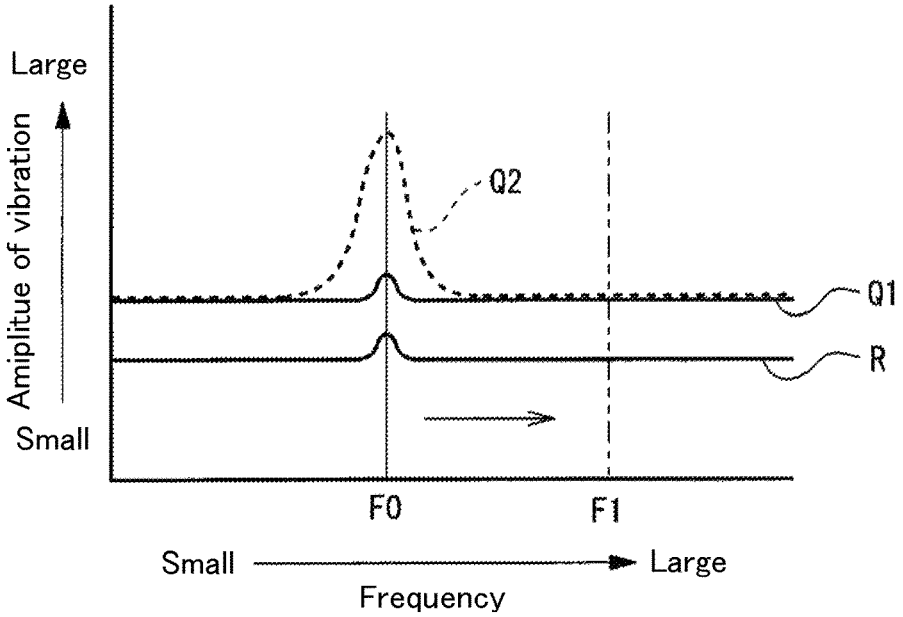
FIG. 7 is a graph showing vibration transmission characteristics of the vibration damping member of the electric compressor of FIG. 1.

Reference is made to the graph in FIG. 7 that shows the vibration transmission characteristic Q1 of the vibration damping member in the compressor according to the first embodiment. In the graph, the abscissa represents the frequency of vibration of the vibration damping member and the ordinate the amplitude of the frequency of the vibration damping member. The broken line Q2 in the graph shows the vibration transmission characteristic of damping member according to the background art. When the electric compressor 10 produces an input vibration R having a vibration component of the frequency F0, the electric compressor 10 resonates at the resonance frequency F0. In the electric compressor 10 according to the first embodiment, in which the filling rate H of the first vibration damping member 33 in the accommodating spaces 35, 36 becomes 100% because of vibration amplitude increased by resonance, the rigidity of the first vibration damping member 33 increases and the resonance frequency of the first vibration damping member 33 shifts from F0 to F1. Because a series of shifts of the resonance frequency of the first vibration damping member 33 from F0 to F1 after the filling rate H of the first vibration damping member 33 has become 100% occur in a fraction of time, there occurs no resonance phenomenon at the frequency F0 and the amplitude Q1 of vibration of the electric compressor 10 decreases as shown in FIG. 7. As the amplitude of vibration of the electric compressor 10 decreases, the filling rate H of the first vibration damping member 33 becomes less than 100% and the resonance frequency of the first vibration damping member 33 shifts from the frequency F1 to the frequency F0. On the other hand, in the case of the electric compressor according to the background art, which is not designed with the filling rate H of a vibration damping member taken into consideration, and in which the filling rate H of the vibration damping member when the amplitude of vibration of the electric compressor is increased can be thought to be less than 100%, no shifting of the resonance frequency from F0 occurs, with the result that the compressor resonances at the resonance frequency F0, as shown by the characteristic Q2 and increases its amplitude of vibration, accordingly.

Figure 8B:
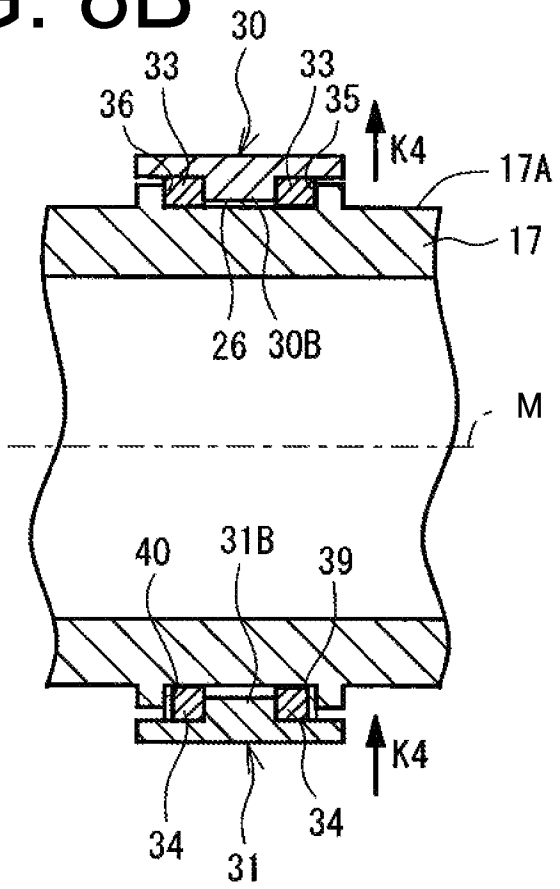
FIGS. 8A and 8B are schematic views showing the effect of the vibration damping member provided throughout the entire circumference of the electric compressor of FIG. 1.
Figure 8A:
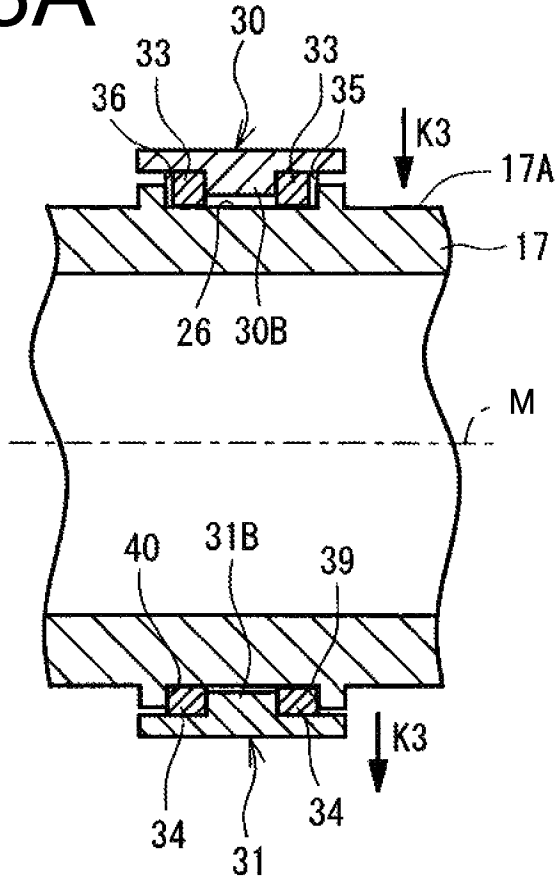

Referring to FIG. 2, the projection 30B of the first support 30 and the projection 31B of the second support 31 are provided extending over the entire periphery of the first housing 17. The recesses 26, 27 are provided extending over the entire periphery of the first housing 17. The accommodating spaces 35-42 formed by the projections 30B, 31B and the recesses 26, 27 and the first and second vibration damping members 33, 34 accommodated in the accommodating spaces 35-42 are provided extending over the first housing 17 throughout the entire periphery thereof. Reference is now made to the schematic views of FIGS. 8A and 8B showing the relation between the vibration of the electric compressor 10 due to the resonance and the filling rate of the vibration damping members in the accommodating spaces. As shown in the drawings, the first vibration damping members 33 are accommodated in the accommodating spaces 35, 36, respectively and the second vibration damping members 34 are accommodated in the accommodating spaces 39, 40, respectively. The accommodating spaces 35, 36 and the accommodating spaces 39, 40 are illustrated in the drawings on the opposite sides of the axis M of the drive shaft 12A as seen in a fragmentary longitudinal cross sectional view of the compressor take along a horizontal plane.

Let us suppose that, when the electric compressor 10 produces large amplitude of vibration radially, a load K3 is applied to the first and second vibration damping members 33, 34 horizontally through the first housing 17 in the arrow direction as shown in FIG. 8A. In this case, the filling rate H of the first vibration damping member 33 in the accommodating spaces 35, 36 decreases less than 100% in a region of the accommodating spaces 35, 36 where the load K3 is applied maximally. In a region of the accommodating spaces 39, 40 where the load K3 is applied maximally, on the other hand, the filling rate H of the second vibration damping member 34 increases to 100%. In the region of the accommodating spaces 39, 40 where the load K3 is applied maximally, the second vibration damping member 34 directly receives the load K3. That is, when the electric compressor 10 resonances at the resonance frequency F0 and the amplitude of vibration of the electric compressor 10 increases, the filling rate H of the second vibration damping member 34 increases and becomes 100% in a region of the accommodating spaces 39, 40. As a result, the rigidity of the second vibration damping member 34 increases and the resonance frequency of the second vibration damping member 34 shifts from F0 to F1. Therefore, there occurs no resonance at the frequency F0 in the electric compressor 10 and the amplitude of vibration of the electric compressor 10 deceases.

Let us suppose that, when the electric compressor 10 produces large amplitude of vibration radially, a load K4 is applied to the first and second vibration damping members 33, 34 horizontally through the first housing 17 in the arrow direction as shown in FIG. 8B. The load K4 has substantially the same magnitude as the load K3, but acts in opposite direction to the load K3. In a region of the accommodating spaces 35, 36 where the load K4 is applied maximally, the filling rate H of the first vibration damping member 33 increases and becomes 100%. On the other hand, in a region of the accommodating spaces 39, 40 where the load K4 is applied maximally, the filling rate H of the second vibration damping member 34 decreases and becomes less than 100%. In the region of the accommodating spaces 39, 40 where the load K4 is applied maximally, the first vibration damping member 33 directly receives the load K4. That is, when the electric compressor 10 resonances at the resonance frequency F0 and the amplitude of vibration of the electric compressor 10 increases, the filling rate H of the first vibration damping member 33 increases and becomes 100% in a region of the accommodating spaces 35, 36. As a result, the rigidity of the first vibration damping member 33 increases and the resonance frequency of the first vibration damping member 33 shifts from F0 to F1. Therefore, there occurs no resonance phenomenon at the frequency F0 in the electric compressor 10 and the amplitude of vibration of the electric compressor 10 deceases. Because the filling rate of the vibration damping members thus becomes 100% in a region of the accommodating spaces in the circumferential direction thereof, the vibration of the electric compressor 10 having an increased amplitude due to the resonance can be suppressed throughout the entire periphery of the electric compressor 10.

The electric compressor 10 according to the first embodiment provides the following advantages.

(1) Changing the filling rate H of the first and second vibration damping members 33, 34 in the accommodating spaces 35-42 according to the amplitude of vibration of the electric compressor 10, the resonance frequency of the first and second vibration damping members 33, 34 can be shifted from the frequency F0 that the electric compressor 10 produces to a frequency that is away from the frequency F0 and at which no resonance occurs. Therefore, the vibration of the electric compressor 10 with a large amplitude due to resonance at the frequency F0 can be suppressed. As a result, shifting the resonance frequency of the vibration damping member can suppress the vibration of the electric compressor 10.

(2) In the case that the amplitude of vibration of the electric compressor 10 is small, the filling rate H of the first and second vibration damping members 33, 34 in the accommodating spaces 35-42 is less than 100%, so that the first and second vibration damping members 33, 34 is deformable in the accommodating spaces 35-42 and the rigidity of the first and second vibration damping members 33, 34 is small. Therefore, the resonance frequency of the first and second vibration damping members 33, 34 remains at F0. On the other hand, when the electric compressor 10 is vibrated with a large amplitude, the filling rate H of the first and second vibration damping members 33, 34 in the accommodating spaces 35-42 is increased to 100%, so that the first and second vibration damping members 33, 34 can not be deformed anymore in the accommodating spaces 35-42 and the rigidity of the first and second vibration damping members 33, 34 becomes high. The resonance frequency of the first and second vibration damping members 33, 34 is shifted from F0 to F1. Therefore, the vibration of the electric compressor 10 with a large amplitude due to the resonance at F0 can be suppressed.

(3) The first and second vibration damping members 33, 34 received in the accommodating spaces 35-38 and the accommodating spaces 39-42, respectively, are provided so as to extend over the entire periphery of the first housing 17. Because the filling rate of the vibration damping members in the accommodating spaces becomes 100% in a region of the accommodating space in the circumferential direction thereof, vibration of the electric compressor 10 with a large amplitude in any direction of the electric compressor can be suppressed throughout the entire periphery of the electric compressor 10.

(4) According to the method for manufacturing the electric compressor 10, firstly, a plurality of vibration damping members having different filling rates H for the accommodating spaces 35-42 is prepared. Secondly, the vibration damping members whose can change its resonance frequency by the amplitude of the vibration of the electric compressor 10 are chosen for the first and second vibration damping members from the prepared plural vibration damping members. Thirdly, the chosen vibration damping members are set in the accommodating spaces 35-42 and the supporting members 28, 29 are assembled to the housing 13. Thus, the vibration damping members whose resonance frequency is shifted from the frequency of the vibration of the electric compressor 10 to a frequency at which no resonance occurs can be chosen successively.

Second Embodiment

Figure 9:
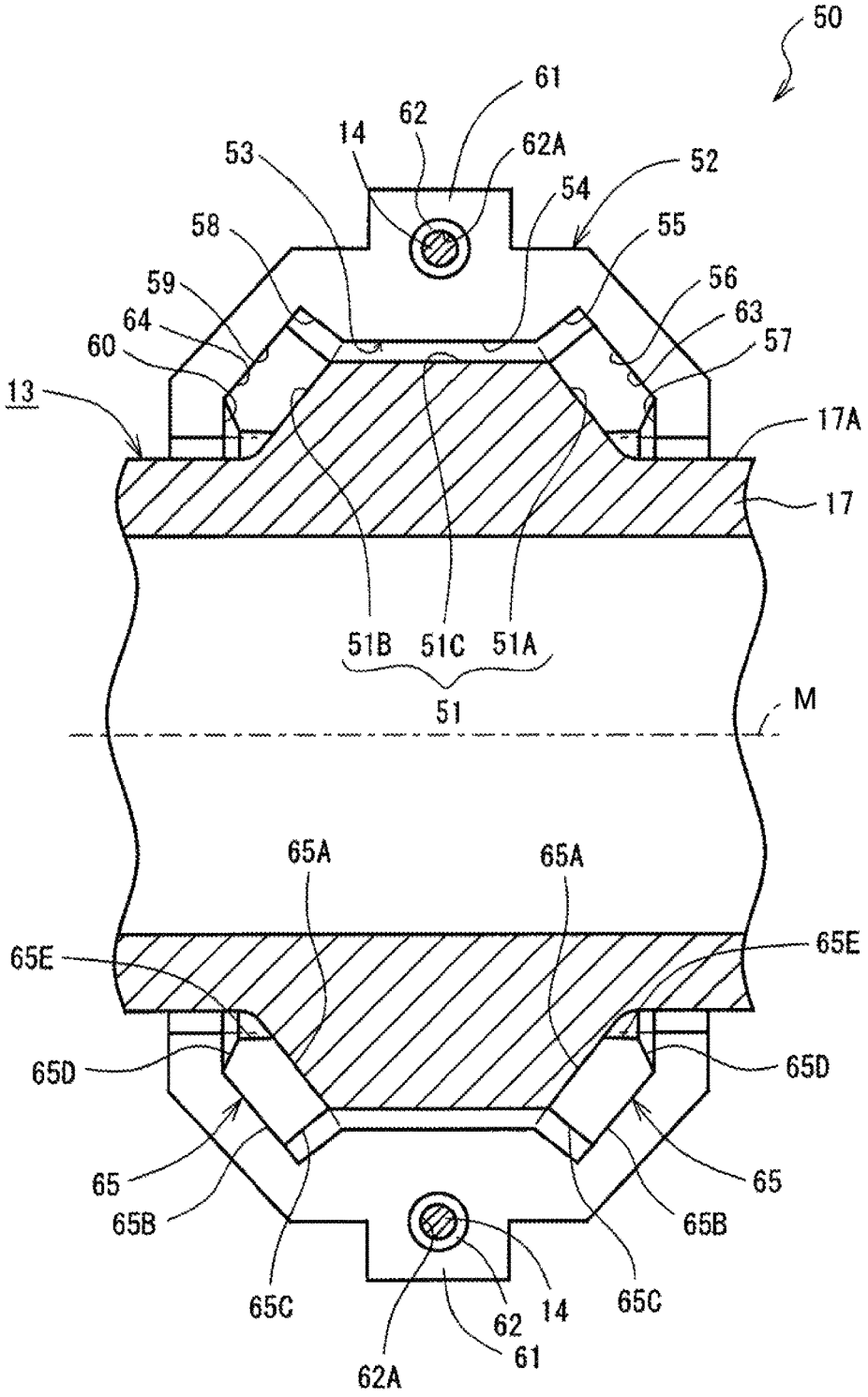
FIG. 9 is an enlarged sectional view of an electric compressor according to a second embodiment of the present invention.

The following will describe an electric compressor 50 of a second embodiment according to the present invention with reference to FIGS. 9 and 10. In the first embodiment, the recesses 26, 27 are recessed from the outer peripheral surface 17A of the first housing 17 and the projections 30B, 31B are formed in the inner peripheral surface of the first and second supports 30, 31. In the second embodiment, a projection 51 is formed extending from the outer peripheral surface 17A of the first housing 17 and a recess 53 is formed in the inner peripheral surface of the first support 52 and the second support (not shown). The rest of the structure of the compressor according to the second embodiment is substantially the same as that of the first embodiment. For the convenience of the explanation, common or similar elements or parts are designated by the same reference numerals as those of the first embodiment and, therefore, the description of such elements or parts will be omitted and only the modifications will be described.

As shown in FIG. 9, the projection 51 is formed extending radially outward and circumferentially over the entire periphery of the first housing 17. The projection 51 is tapered radially outward and has a pair of outer wall surfaces 51A, 51B that is inclined to the outer peripheral surface 17A. The projection 51 has therein an end surface 51C that is at the top of the projection 51 and parallel to the outer peripheral surface 17A of the first housing 17 as seen in the longitudinal section of the electric compressor 50. The projection 51 corresponds to the projections provided extending from the first housing 17.

The first support 52 and the second support (not shown in the drawing) are provided extending around the first housing 17. The first support 52 and the second support have the substantially same shape, so that first and second supports combined together form a cylindrical shape.

As shown in FIG. 9, the recess 53 extends in the first support 52 in the peripheral direction thereof. The recess 53 is recessed radially outward in the first support 52 throughout the entire periphery thereof. The recess 53 is generally tapered radially outward as seen in the longitudinal section of the electric compressor 50. The recess 53 has a bottom surface 54. The recess 53 further has inner wall surfaces 55, 56, 57 that are formed on one side of the bottom surface 54 and continuously with each other as seen in the axial direction of the electric compressor 50. As seen in the cross section of FIG. 9, the inner wall surface 55 is formed extending radially outward from the bottom surface 54, the inner wall surface 56 is formed extending radially inward at a right angle from the inner wall surface 55 and the inner wall surface 57 is formed extending radially inward from the inner wall surface 56.

The recess 53 further has inner wall surfaces 58, 59, 60 that are formed on the other side of the bottom surface 54 and continuously with each other as seen in the axial direction of the electric compressor 50. As seen in the cross section of FIG. 9, the inner wall surface 58 is formed extending radially outward from the bottom surface 54, the inner wall surface 59 is formed extending radially inward at a right angle from the inner wall surface 58 and the inner wall surface 60 is formed extending radially inward from the inner wall surface 59. The inner wall surfaces 55, 56, 57 are formed symmetrical with the inner wall surfaces 58, 59, 60, respectively, with respect to a plane passing through the center of the bottom surface 54 or the center of the holes 62A. The recess 53 is formed by the bottom surface 54 and the inner wall surfaces 55, 56, 57 and the inner wall surfaces 58, 59, 60 that are formed on the opposite sides of the bottom surface 54. The second support has the substantially same shape as the first support 52 and therefore, the description thereof will be omitted.

The recess 53 of the first support 52 and the projection 51 of the first housing 17 are engaged with each other through first vibration damping members 65 which will be described later herein. The same is true of the recess of the second support and the projection 51 of the first housing 17. The first support 52 and the second support are made of a vibration damping member such as resin or fiber reinforced resin. As shown in FIG. 9, each first support 52 has at the opposite circumferential ends thereof two first mount members 61 extending in tangential relation to the outer periphery of the first support 52.

The first mount member 61 has a reinforcement member 62 that is made of metal and formed by insert-molding and has therein a hole 62A. With the first support 52 and the second support (not shown) combined together around the first housing 17, the holes 62A of the first mount member 61 and the second mount member (not shown in the drawing) are set in alignment with each other. The first mount member 61 and the second support are assembled to the object 15 by the bolt 14 inserted through the holes 62A and screwed into the holes (not shown) formed in any frame of object 15.

As shown in FIG. 9, when the first support 52 is disposed above the first housing 17 so that the projection 51 of the first housing 17 is accommodated in the recess 53, two separate accommodating spaces 63, 64 are formed by the projection 51 of the first housing 17 and the recess 53 of the first support 52. The accommodating spaces 63, 64 are formed on opposite sides of the projection 51. The accommodating space 63 is formed by the inner wall surfaces 55, 56, 57 of the first support 52 and the outer wall surface 51A of the projection 51 of the first housing 17. The inner wall surface 56 and the outer wall surface 51A are provided parallel to and in facing relation to each other in the accommodating space 63 extending orthogonally to the inner wall surface 55. The accommodating space 64 is formed by the inner wall surfaces 58, 59, 60 of the first support 52 and the outer wall surface 51B of the projection 51 of the first housing 17. The inner wall surface 59 and the outer wall surface 51B are provided parallel to and in facing relation to each other and extending orthogonally to the inner wall surface 58.

The aforementioned first vibration damping member 65 is provided in a deformed state or in a curved shape in each of the accommodating spaces 63, 64. In this state, the first vibration damping member 65 is provided so that the accommodating spaces 63, 64 have therein a clearance that is formed between the first vibration damping member 65 and the accommodating spaces 63, 64. The first vibration damping member 65 is made of rubber, or such material having at least one of heat resistance and durability as silicon rubber or ethylene-propylene rubber. The first vibration damping member 65 is formed of a plate member of a rectangular section, having an inner peripheral surface 65A, an outer peripheral surface 65B, a side surface 65C, and two bevel surfaces 65D, 65E formed on the opposite side of the first vibration damping member 65 from the side surface 65C. The inner peripheral surface 65A and the outer peripheral surface 65B are parallel to each other and perpendicular to the side surface 65C.

The first vibration damping member 65 is provided in the accommodating space 63 so that the inner peripheral surface 65A is in contact with the outer wall surface 51A of the projection 51, the outer peripheral surface 65B is in contact with the inner wall surface 56 of the recess 53, and the bevel surfaces 65D, 65E are positioned adjacent to the outer peripheral surface 17A of the first housing 17. The first vibration damping member 65 is provided in the accommodating spaces 64 so that the inner peripheral surface 65A is in contact with the outer wall surface 51B of the projection 51, the outer peripheral surface 65B is in contact with the inner wall surface 59 of the recess 53, and the bevel surfaces 65D, 65E are positioned adjacent to the outer peripheral surface 17A of the first housing 17.

The filling rate H of the first vibration damping member 65 in the accommodating spaces 63, 64 is changeable according to the amplitude of vibration of the electric compressor 50. It is so configured that, when the amplitude of vibration of the electric compressor 50 is small, the filling rate H of the first vibration damping member 65 in the accommodating spaces 63, 64 is less than 100%. When the amplitude of vibration of the electric compressor 50 is large, the filling rate H of the first vibration damping member 65 in the accommodating spaces 63, 64 is increased to 100%. When the filling rate H of the first vibration damping member 65 in the accommodating spaces 63, 64 is increased to be 100%, the resonance frequency of the first vibration damping member 65 is shifted.

Figure 10A:
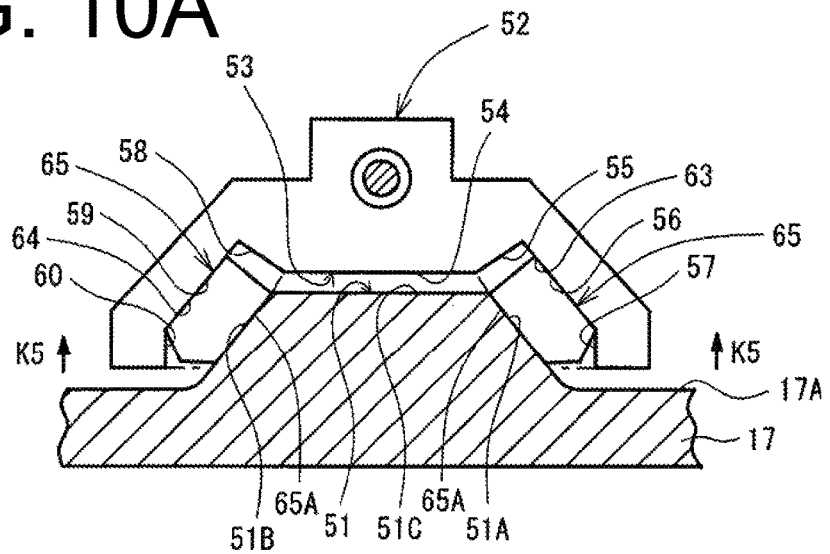
FIGS. 10A and 10B are schematic views showing the relation between the vibration of the electric compressor of FIG. 9 and the filling ratio of the vibration damping member.
Figure 10B:
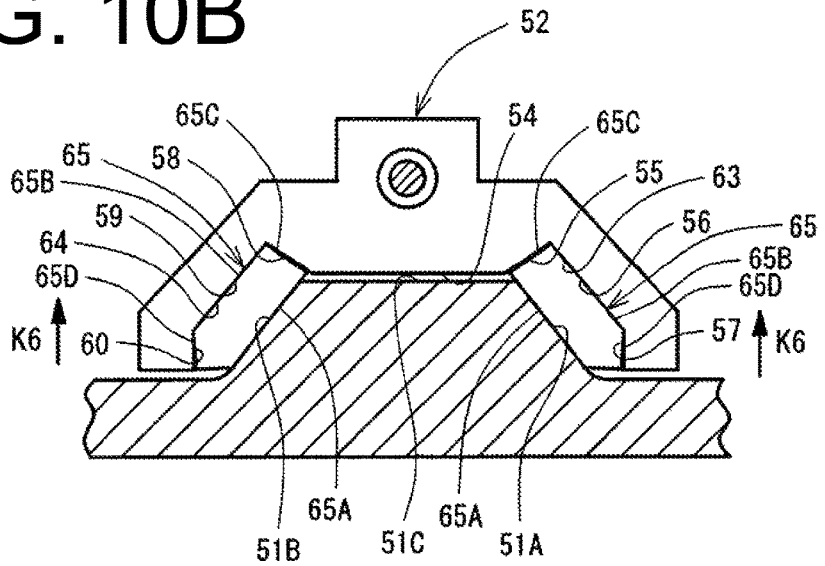

The following will describe the operation of the electric compressor 50 of the second embodiment with reference to FIGS. 10A and 10B. When the electric compressor 50 is operating with a small amplitude of vibration, a small load K5 is applied to the first vibration damping member 65 through the first housing 17, so that deformation of the first vibration damping member 65 is small and the filling rate H of the first vibration damping member 65 remains less than 100%, as shown in FIG. 10A. That is, the accommodating spaces 63, 64 have therein a clearance and the first vibration damping member 65. Because of the presence of the clearance, non-contact surface of the first vibration damping member 65 is secured and the rigidity of the first vibration damping member 65 is restrained to be small.

On the other hand, when the amplitude of vibration of the electric compressor 50 is large, a large load K6 is applied to the first vibration damping member 65 through the first housing 17 as shown in FIG. 10B, so that deformation of the first vibration damping member 65 is large and the filling rate H of the first vibration damping member 65 becomes 100%. Then, the accommodating spaces 63, 64 have therein no clearance and the first vibration damping member 65 can not be deformed anymore, so that the rigidity of the first vibration damping member 65 is increased. That is, the first vibration damping member 65 is compressed in the perpendicular direction to the outer wall surface 51A and 51B of the projection 51 by the large amplitude of vibration of the electric compressor 50 and deformed to be expanded in the direction that is parallel to the outer wall surface 51A and 51B. As a result, the side surface 65C and the bevel surface 65D of the first vibration damping member 65 are brought into contact with the inner wall surfaces 55, 58 and the inner wall surfaces 57, 60 of the first support 52, respectively. It is noted that the bevel surface 65E of the first vibration damping member 65 is clear of contact with the outer peripheral surface 17A of the first housing 17.

When the electric compressor 50 produces an input vibration R having a vibration component of the frequency F0, the electric compressor 50 resonates at the resonance frequency F0. In the electric compressor 50 according to the second embodiment, when the filling rate H of the first vibration damping member 65 of the accommodating spaces 63, 64 is increased to 100% because of the vibration amplitude increased by resonance, the rigidity of the first vibration damping member 65 increases and the resonance frequency of the first vibration damping member 65 shifts from F0 to F1. Because of a series of changes of the resonance frequency of the first vibration damping member 65 after the filling rate H of the first vibration damping member 65 has become 100% occur in a fraction of time, there occurs no resonance at the frequency F0 and the amplitude of vibration of the electric compressor 50 decreases. As the amplitude of vibration of the electric compressor 50 decreases, the filling rate H of the first vibration damping member 65 becomes less than 100%, so that the resonance frequency of the first vibration damping member 65 returns to the frequency F0 from the frequency F1. The advantages of the electric compressor 50 according to the second embodiment are the same as the advantages (1) through (4) of the electric compressor 10 according to the first embodiment.

The present invention is not limited to the above-described embodiments, but may be modified into various alternative embodiments, as exemplified below.

Though, in the second embodiment, the first vibration damping member 65 is formed of a plate member of a rectangular section having the two bevel surfaces 65D, 65E formed on the opposite side of the first vibration damping member 65 from the side surface 65C, the first vibration damping member may be formed of a rectangular sectional member having a surface instead of the bevel surfaces 65D, 65E, that is formed extending parallel to the side surface 65C. In this case, the accommodating space also has a rectangular sectional shape.

The housing and the support may be formed in any shape as long as one of the housing and the support has the projection and the other of the housing and the support has therein the recess so that an accommodating space is formed between the housing and the support by the projection and the inner surface of the recess and a vibration damping member is received in the accommodated space. The vibration damping member may be provided so as to extend partially around the first housing, instead of extending around the entire periphery of the first housing. The vibration damping member is not limited to a plate, but may be of various shapes according to the shape of the accommodating space in which the damping member is received. For example, the vibration damping member may have such a shape in cross section as cylinder, oval, circle and polygon.

In the first and second embodiments, the electric compressors 10, 50 have been described as having such a vibration damping member that the filling rate of the vibration damping member in the accommodating space becomes 100% in response to the application of vibration with a large amplitude due to the resonance and the resonance frequency of the first vibration damping member is shifted. The amplitude of vibration of an electric compressor produced by the resonance is variable depending on various conditions such as vehicle type and the location of compressor mounting. Therefore, the filling rate H of the vibration damping member in the accommodating space can be selected according to the conditions in which the electric compressor is mounted.

In the first and second embodiments, the properties of rubber used as the material of the vibration damping member such as resonance frequency and rigidity (spring constant) may be changed for the desired resonance frequency. That is, the material and the rigidity of a vibration damping member may be changed according to the vehicle on which the electric compressor is mounted and the place of the vehicle at which the electric compressor is mounted. In this case, because the resonance frequency varies depending on the mounting conditions such as the vehicle type and the place of the vehicle at which the electric compressor is mounted, the vibration damping member needs to be customized according to the mounting conditions of the electric compressor.

What is claimed is:

1. An electric compressor to be fixed to an object comprising:

a compressor for compressing refrigerant;

an electric motor for driving the compressor;

a housing forming a cylindrical shape and accommodating therein the compressor and the electric motor; and a supporting member fixed to the object and provided to an outer peripheral surface of the housing, wherein the housing and the supporting member are not directly connected, wherein one of the housing and the supporting member has a projection, wherein the other of the housing and the supporting member has a recess, wherein a plurality of vibration damping members are provided on opposite sides of the projection, so as to have the projection disposed between the plurality of vibration damping members, wherein the vibration damping members have elasticity, wherein the supporting member is configured to support the housing through each of the vibration damping members by contact of the vibration damping members with both the housing and the supporting member in a radial direction of the housing, wherein, according to first amplitudes of vibration of the electric compressor, which are applied to the respective vibration damping members, a clearance is formed between the projection or the recess and the vibration damping members in an axial direction of the electric motor, and wherein according to second amplitudes of vibration of the electric compressor, which are applied to the respective vibration damping members, the vibration damping members are in contact with the projection and the recess in the axial direction by decreasing of a distance between the supporting member and the housing and no clearance is present between the projection or the recess and each of the vibration damping members in the axial direction, wherein the first amplitudes of vibration are smaller than the second amplitudes of vibration.

2. The electric compressor according to claim 1, wherein each of the vibration damping members is provided to surround an entire circumference of the outer peripheral surface of the housing.

3. The electric compressor according to claim 1, wherein a different clearance is provided between the projection or the recess and each of the vibration damping members in the axial direction.

4. The electric compressor according to claim 2, wherein a different clearance is provided between the projection or the recess and each of the vibration damping members in the axial direction.

* * * * *